US006505671B1

(12) United States Patent
McKibben et al.

(10) Patent No.: US 6,505,671 B1
(45) Date of Patent: Jan. 14, 2003

(54) METHOD FOR PRODUCING A SAND CORE

(75) Inventors: Kenneth D. McKibben, Defiance, OH (US); Daniel D. Minor, Cadillac, MI (US); Alan P. Gould, Tawas City, MI (US); Mark Salgat, Pinconning, MI (US); Diane Zekind, Farmington Hills, MI (US); Karl D. Voss, West Bloomfield, MI (US)

(73) Assignee: Hayes Lemmerz International, Inc., Northville, MI (US)

( * ) Notice: Subject to any disclaimer, the term of this patent is extended or adjusted under 35 U.S.C. 154(b) by 0 days.

(21) Appl. No.: 09/751,470

(22) Filed: Dec. 28, 2000

(51) Int. Cl.[7] ..... B22C 9/12

(52) U.S. Cl. ..... 164/12; 164/16; 164/520; 106/38.2

(58) Field of Search ..... 164/16, 12, 20, 164/22, 200, 4.1, 456, 520, 521, 522; 523/139; 264/82; 106/38.2

(56) References Cited

U.S. PATENT DOCUMENTS

| | | | | | |
|---|---|---|---|---|---|
| 3,590,902 | A | * | 7/1971 | Walker et al. | 164/526 |
| 3,795,726 | A | * | 3/1974 | Zifferer et al. | 264/82 |
| 3,919,162 | A | * | 11/1975 | Austin | 523/145 |
| 4,051,886 | A | * | 10/1977 | Ross | 164/16 |
| 4,064,926 | A | * | 12/1977 | Naegele | 164/154.8 |
| 4,644,994 | A | * | 2/1987 | Michel | 164/12 |
| RE32,720 | E | | 7/1988 | Lemon et al. | 523/145 |
| RE32,812 | E | | 12/1988 | Lemon et al. | 523/145 |
| 5,325,909 | A | * | 7/1994 | Unterderweide | 164/456 |
| 5,386,868 | A | * | 2/1995 | Kingman et al. | 164/456 |
| 5,646,199 | A | | 7/1997 | Yoshida et al. | 523/139 |
| 5,711,792 | A | * | 1/1998 | Miller | 106/38.22 |
| 5,749,409 | A | | 5/1998 | Siak et al. | 164/23 |
| 5,971,056 | A | * | 10/1999 | Bovens | 164/16 |

FOREIGN PATENT DOCUMENTS

| | | | | |
|---|---|---|---|---|
| FR | 2 189 146 | * | 3/1974 | B22C/9/00 |
| JP | 59-197340 | * | 11/1984 | B22C/1/26 |

OTHER PUBLICATIONS

American Foundrymen'Society, Inc, R.L. Manning and L.S. Zaretskiy, A New Generation of Inorganic Binders, Apr. 20–23, 1997.

Technical Presentation Cordis Update, Hayes Lemmerz Technical Center, Mar. 2, 2000.

Effects of a New Inorganic Binder on Green Sand Properties and Casting Results, R.L. Manning et al., pp. 97–105.

* cited by examiner

*Primary Examiner*—M. Alexandra Elve
*Assistant Examiner*—Kevin P. Kerns
(74) *Attorney, Agent, or Firm*—MacMillan, Sobanski & Todd, LLC

(57) ABSTRACT

A method for producing a sand core includes the following steps: (a) providing a casting mold having a mold cavity, the casting mold including at least one first conduit and at least one second conduit; (b) providing a sand core disposed in the mold cavity; (c) providing a supply of conditioning gas to the casting mold, the conditioning gas being supplied to the casting mold through at least one of the first and second conduits; (d) providing a controller connected to the first conduit and the second conduit to selectively control the supply of conditioning gas; (e) providing a gas exhaust unit operatively connected to the casting mold; (f) operating the gas exhaust unit to cause the conditioning gas to be moved through the sand core; and (g) removing the sand core from the casting mold.

18 Claims, 1 Drawing Sheet

METHOD FOR PRODUCING A SAND CORE

BACKGROUND OF THE INVENTION

This invention relates in general to sand cores and in particular to an improved method for producing such a sand core.

A sand core is well known in the foundry art for forming and shaping internal cavities and openings in finished castings. The internal cavities and openings offer the advantage of allowing for a lower weight and more reliable finished casting. Oftentimes, these cavities and openings cannot be made using permanent, reusable molds and the like. Another way to produce these openings is to mold the casting around a one-time-only core which complements the configuration of the intended cavities and openings. After making the casting, the core can be destroyed or disintegrated, thereby leaving the cavities and openings in the casting available for their intended purpose.

The above one-time-only cores are commonly used in the foundry and casting industries. Manufacturers that desire a lower weight, strong finished casting typically employ sand cores in their production methods. For example, the automotive industry employs sand cores to make lower weight, fuel efficient automobile cast component parts.

Suitable materials are needed to produce the cores. The cores are typically made of materials which allow the cores to be formed into complex shapes or configurations so as to complement the cavities and openings to be created in the finished molded product. The materials must also be stable or strong enough to withstand the molding process for the application they are intended, yet weak enough so as to be easily disintegrated and removed upon completion of the molding process.

Foundry cores made of sand are produced from a variety of known methods, some of which include hot box, warm box, shell, oil sand, cement, and cold box methods. Foundry sand binders that are used for making the cores can be classified in one of two main chemical classes: organic and inorganic. Organic sand cores can employ compounds that are environmentally unfriendly. With an increased amount of concern being given to preserving the environment, the relatively environmentally friendly inorganic cores, such as those which are sand-based, grow in popularity.

A conventional inorganic sand core is formed by adding a binder to the sand to form a binder/sand mix before placing the binder/sand mix into a mold. In the mold, the binder/sand mix is shaped into a sand core having a desired shape. U.S. Pat. No. 5,711,792 to Miller discloses a foundry binder which can be used in producing inorganic sand cores. A discussed in the Miller patent, the flowability of the binder/sand mix or the ability of the binder/sand mix to properly fill the mold is an important characteristic for a properly shaped and stable sand core. The flowability of the binder/sand mix is also important to fill the molds efficiently, which promotes an acceptable production rate.

While the use of the binder provides the benefit of additional strength, it can reduce the user's ability to handle the sand and to form intricate and complex shaped cores. Also, the temperature and humidity conditions at which the core is produced and stored can cause the core to soften and possibly lose its shape over time. Thus, it would thus be desirable to be able to produce a non-organic sand core which is durable, can be of an intricate and complex shape, yet is economical and relatively easy to produce.

SUMMARY OF THE INVENTION

This invention relates to a method for producing a core and includes the steps of: (a) providing a casting mold having a mold cavity, the casting mold including at least one first conduit and at least one second conduit; (b) providing a sand core disposed in the mold cavity; (c) providing a supply of conditioning gas to the casting mold, the conditioning gas being supplied to the casting mold through at least one of the first and second conduits; (d) providing a gas exhaust unit operatively connected to the casting mold; (e) operating the gas exhaust unit to cause the conditioning gas to be moved through the sand core; and (f) removing the sand core from the casting mold.

Other advantages of this invention will become apparent to those skilled in the art from the following detailed description of the preferred embodiment, when read in light of the accompanying drawings.

DESCRIPTION OF THE PREFERRED EMBODIMENT

Figure 1:
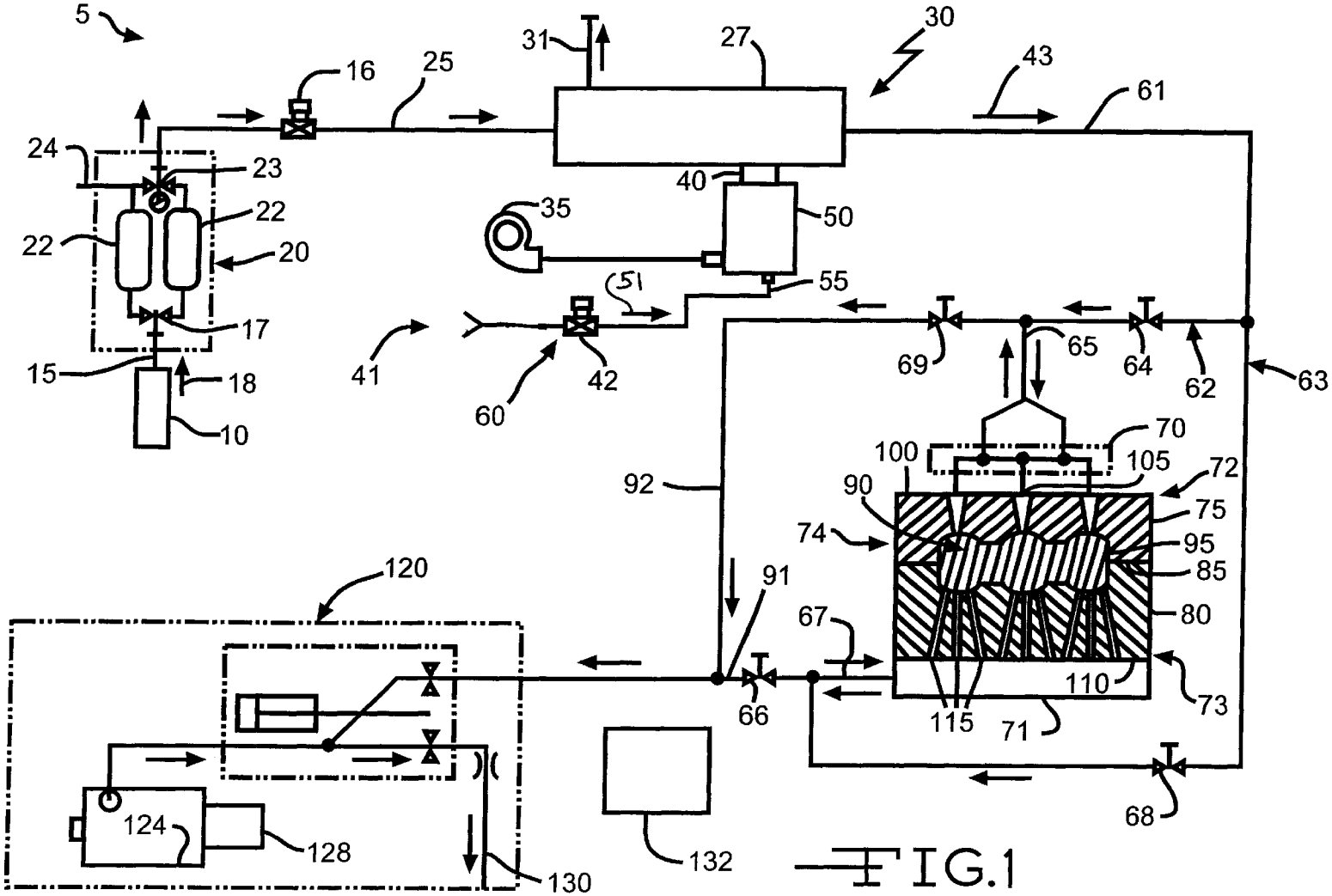
FIG. 1 is a schematic diagram of a core producing system for producing an inorganic sand core in accordance with the present invention.

Referring now to FIG. 1, there is illustrated a schematic diagram of a core producing system, indicated generally at 5, for producing an inorganic sand core in accordance with the present invention. As shown therein, the core producing system 5 includes a conditioning gas dryer 20 which supplies a source of dried conditioning gas to a heater 30. The heater 30 heats the dried conditioning gas and supplies the heated conditioning gas to a casting mold 74. The core producing system 5 further includes a vacuum unit 120 which is operative to assist in processing the conditioning gas used in the core producing system 5 as described below in detail.

In the illustrated core producing system 5, a compressor 10 delivers a supply of a conditioning gas through a conduit 15 to the conditioning gas dryer 20 through a control valve 17, as indicated by the arrow 18. The conditioning gas may be atmospheric air or any other suitable gas or fluid. The conditioning gas supplied by the compressor 10 to the conditioning gas dryer 20 is at a predetermined pressure, preferably at a pressure of about 100 p.s.i. The illustrated conditioning gas dryer 20 includes two desiccant tanks 22, though any suitable number of desiccant tanks 22 may be used. When two desiccant tanks 22 are employed, one desiccant tank 22 can be employed during operation of the core producing system 5 while the other desiccant tank 22 can be serviced or regenerated, thus minimizing the downtime of the core producing system 5 due to maintenance of the desiccant tanks 22. A valve 23 is employed to selectively control the flow of the conditioning gas from the desiccant tanks 22 to the atmosphere via an exhaust line 24 or to the heater 30 via a conduit 25.

The conditioning gas dryer 20 of the invention preferably dries or dehumidifies the conditioning gas to a desired dew point of within the range of from about minus 10 degrees Fahrenheit (−10° F.) to about minus 40 degrees Fahrenheit (−40° F.). It should be understood that the conditioning gas may be dried to a different degree and any suitable type of conditioning gas dryer 20 may be used to accomplish this. A suitable conditioning gas dryer 20 that can be used is a MBCI Model h-600 heatless desiccant dryer with NEMA 4 controls and a blue moisture indicator, manufactured by Daniel L. Bowers Co., Inc. of Rochester Hills, Mich.

The dried conditioning gas from the conditioning gas dryer 20 is then heated in accordance with this invention to a temperature of within the range of from about 200 degrees Fahrenheit (200° F.) to about 400 degrees Fahrenheit (400° F.). To accomplish this, the core producing system 5 includes the conduit 25 which is operative to supply the dried conditioning gas from the conditioning gas dryer 20 to the heater 30. Preferably, in the illustrated embodiment, the core producing system 5 includes an air control valve 16 in the path of the conduit which is operative to selectively control the supply of the dried conditioning gas from the conditioning gas dryer 20 to the heater 30.

The illustrated heater 30 includes a heat exchanger 27, a combustion chamber 50, and a burner 55. The heater 30 is preferably a natural gas fired heater; however any suitable heater 30 can be used, including an electrical air heater.

The heat exchanger 27 includes one or more heat exchanger tubes (not shown) which are operative to heat the dried conditioning gas supplied to the heater 30 from the conditioning gas dryer 20. A suitable heat exchanger 27 is available from Thermal Transfer Corporation of Monroeville, Pa.

The heat exchanger 27 receives a supply of heated fluid from the combustion chamber 50 through a suitable conduit 40 into the heat exchanger tubes. The dried conditioning gas enters the heat exchanger 27 from the conditioning gas dryer 20. The dried conditioning gas does not commingle with the heated fluid in the heat exchanger tubes. The dried conditioning gas is heated by the heated fluid in the heat exchanger tubes in the heat exchanger 27. The supply of the dried conditioning gas passing through the heat exchanger 27 and exiting therefrom is delivered to a supply line or conduit 61, as indicated by the arrow 43.

It should be understood that any suitable type of combustion chamber 50 can be used. A suitable combustion chamber 50 is a Model 600M-DL2 manufactured by Pyronics, Inc. of Cleveland, Ohio. The combustion chamber 50 preferably includes an insulated jacket (not shown) and a flanged flue gas outlet 31. In the preferred embodiment, a 1/16 DIN digital temperature control, and a 1/16 DIN high temperature limit control, manufactured by Clos-Vendal, also known as C.V.A. Inc. of Dearborn Heights, Mich. are provided for controlling the combustion in the combustion chamber 50. In the illustrated embodiment, a blower 35 is provided and used to supply the fluid to be heated in the combustion chamber 50, which is then supplied to the heat exchanger 27. The combustion chamber 50 further includes a thermocouple (not shown) to control the heating of the combustion chamber 50 by the burner 55.

The burner 55 supplies heat by a flame to the combustion chamber 50. It should be understood that any suitable type of burner 55 may be used. A suitable burner 55 which can be used is a spark igniter model TA100, fired excess air, manufactured by Pyronics, Inc. of Cleveland, Ohio. It should be understood that the combustion chamber 50 and burner 55 can be other than illustrated. Also, a plurality of combustion chambers 50 and burners 55 can also be used.

A suitable gas supply train 60 can be employed to deliver a supply of natural gas 41 to the burner 55. In the illustrated embodiment, the gas supply train 60 includes a control valve 42 to facilitate the flow of gas through the gas supply train 60 in the direction of arrow 51. The preferred controls for the heater 30 include a flame monitor (not shown), the gas supply train 60, and a temperature control (not shown). A suitable flame monitor is a model RM7890A. manufactured by Honeywell, Inc. of Minneapolis, Minn. Conventional interlocks, shutoff valves, regulators, and proportional control valves are preferably included with the gas supply train 60. Alternatively, other suitable flame monitors, gas valve trains 60, temperature controls and thermocouples can be used if desired.

The supply line 61 is divided so as to be operative to supply the heated conditioning gas from the heater 30 to a first gas circuit, indicated generally at 62, and a second gas circuit, indicated generally at 63. The first gas circuit 62 and the second gas circuit 63 are configured such that the heated conditioning gas from the heater 30 preferably flows through the first gas circuit 62 and the second gas circuit 63. It should be understood that the heated conditioning gas from the supply line 61 as discussed herein is preferably dried and heated conditioning gas when delivered to the casting mold 74.

The illustrated first gas circuit 62 includes a first control valve 64 to regulate the flow of the conditioning gas through a first common conduit 65 and a second control valve 66 to regulate the flow of the conditioning gas through a second common conduit 67. The first control valve 64 and the second control valve 66 preferably include an opened position and a closed position. The first control valve 64 and the second control valve 66 may be infinitely variable between the opened position and the closed position. As will be discussed below, the first control valve 64 and the second control valve 66 cooperate when in their opened positions to allow the conditioning gas to flow through the core producing system 5 into the casting mold 74.

The illustrated first gas circuit 62 includes a first manifold 70 on a first side or end 72 of the casting mold 74 and a second manifold 71 on a second opposite side or end 73 of the casting mold 74. The flow of the conditioning gas through the first gas circuit 62 is from the first side 72 of the casting mold 74 to the second side 73. The illustrated first gas circuit 62 also includes a conduit 91 which allows for fluid communication between the second valve 66 and the vacuum unit 120.

The illustrated second gas circuit 63 includes a third control valve 68 to regulate the flow of the conditioning gas through the second common conduit 67 and a fourth control valve 69 to regulate the flow of the conditioning gas through the first common conduit 65. The third control valve 68 and the fourth control valve 69 include an opened position and a closed position. The third control valve 68 and the fourth control valve 69 may be infinitely variable between the opened position and the closed position. As will be discussed below, the third control valve 68 and the fourth control valve 69 cooperate when in their opened positions to allow the conditioning gas to flow through the core producing system 5 illustrated into the casting mold 74. The flow of the conditioning gas through the second gas circuit 63 illustrated is from the second side 73 of the casting mold 74 to the first side 72. The illustrated second gas circuit 63 also includes a conduit 92 which allows for fluid communication between the fourth control valve 69 and the vacuum unit 120.

The flow of the conditioning gas through the first gas circuit 62 occurs when the first control valve 64 and the second control valve 66 are substantially in their opened positions, and the third control valve 68 and the fourth control valve 69 are substantially in their closed positions. The flow of the conditioning gas through the second gas circuit 63 occurs when the third control valve 68 and the fourth control valve 69 are substantially in their opened positions, and the first control valve 64 and the second control valve 66 are substantially in their closed positions.

The core producing system 5 preferably includes a controller 132 which is operative to control the operation of the first control valve 64, the second control valve 66, the third control valve 68, and the fourth control valve 69. The controller 132 regulates the flow of the conditioning gas from the supply line 61 to the first gas circuit 62 and the second gas circuit 63. The controller 132 may be any suitable type of controller, mechanical or electrical controller and/or automatic or manual.

The illustrated casting mold 74 is a core box. The casting mold 74 includes a first mold half or cope 75 which is operatively joined to a second mold half or drag 80 along a parting line 85 and which defines a mold cavity 90. A core 95 is disposed in the mold cavity 90. The core 95 is preferably a foundry core made of sand. It should be understood that the term "sand" as used herein includes binders or other chemicals mixed with or applied to the sand. It should be understood that the core 95 is approximately the same shape and contour as that of the mold cavity 90.

In the illustrated embodiment, the casting mold 74 includes a first wall 100 having a plurality of first feed gates 105 formed therein which establish fluid communication between the mold cavity 90 and the first wall 100 of the casting mold 74. For the sake of clarity, only three of such first feed gates 105 are shown; however, any suitable number of the first feed gates 105 may be employed. The casting mold 74 further includes a second wall 110 having a plurality of second feed gates 115 formed therein which establish fluid communication between the mold cavity 90 and the second wall 110 of the casting mold 74. For the sake of clarity, only nine of such second feed gates 115 are shown; however, any suitable number of the second feed gates 115 may be employed. The first feed gates 105 and the second feed gates 115 are preferably generally round and may have any suitable diameter, but need not have the same diameter.

The casting mold 74 is constructed from conventional foundry mold materials and according to conventional practices known in the art. Metal dies may also be used. As conditioning gas flows through the casting mold 74, the conditioning gas flows through the associated core 95 disposed therewithin. The vacuum unit 120 is preferably provided to facilitate the removal of the gas from the core 95. The vacuum unit 120 receives conditioning gas from the first gas circuit 62 and the second gas circuit 63. The illustrated vacuum unit 120 is a turbine unit vacuum and includes a turbine 124 with a motor 128. An exhaust 130 is provided to facilitate the removal of the moisture from the core producing system 5. Alternatively, the vacuum unit 120 can be replaced with other suitable exhaust means for exhausting the gas from the casting mold 74 if so desired.

It should be understood that the compressor 10 and the vacuum unit 120 are each a means for moving the dried heated conditioning gas through the core 95. Alternatively, other means for moving the dried heated conditioning gas through the core 95 may be employed.

Without wishing to be bound by theory, it is believed that the casting mold 74 and the core 95 contain excess moisture before the application of the conditioning gas. Thus, in accordance with the present invention, a more desirable core 95 is produced by optimally reducing moisture in the core 95 according to the method described above.

The present invention can be practiced in a number of environments, including but not limited to warm/hot box, warm box/warm air, and no bake environments. To practice the invention in the warm/hot box environment, the box temperature is preferably employed at a temperature range of from about 300 degrees Fahrenheit to about 450 degrees Fahrenheit. To practice the invention in the warm box/warm air environment, the box temperature is preferably employed at a temperature range of from about 180 degrees Fahrenheit to about 400 degrees Fahrenheit and the temperature of the conditioning gas, including the purged conditioning gas, is preferably at a temperature range of from about 200 degrees Fahrenheit to about 350 degrees Fahrenheit. To practice the invention in the no bake environment, typical organic ester catalysts are employed. While the description above is directed to the production of inorganic cores, the invention may be used in conjunction with the production of organic cores where suitable.

The conditioning gas to be used to treat the shaped sand core 95 is preferably conditioned in the core producing system 5 in one or more ways before it is applied to the shaped sand core 95. The conditioning gas is preferably compressed, dried, and heated as discussed below. It should be understood that not all three ways of treating the conditioning gas need be employed. Likewise, the ways of treating the conditioning gas need not be employed in the way or order discussed herein.

In accordance with the provisions of the patents statues, the principle and mode of operation of this invention have been described and illustrated in its preferred embodiments. However, it must be understood that the invention may be practiced otherwise than as specifically explained and illustrated without departing from the scope or spirit of the attached claims.

What is claimed is:

1. A method for producing a sand core by removing moisture from the sand core comprising the steps of:

(a) providing a casting mold having a mold cavity and including a first conduit operatively connected to the mold cavity and a second conduit operatively connected to the mold cavity;

(b) providing a sand core disposed in the mold cavity, the sand core containing moisture;

(c) providing a supply of conditioning gas to the first conduit and the second conduit to remove the moisture from the sand core, the conditioning gas being dehumidified;

(d) providing a controller operatively connected to the first conduit and the second conduit to selectively control the supply of the conditioning gas between a first gas path, wherein the conditioning gas enters the casting mold through the first conduit and exits the casting mold through the second conduit, and a second gas path, wherein the conditioning gas enters the casting mold through the second conduit and exits the casting mold through the first conduit;

(e) providing a gas exhaust unit operatively connected to the first conduit and the second conduit;

(f) operating the controller and the gas exhaust unit to cause the conditioning gas to be selectively moved through the sand core disposed in the mold cavity, the conditioning gas moving through the sand core in at least one of the paths defined by the first gas path and the second gas path whereby the conditioning gas is operative to remove the moisture from the sand core; and (g) removing the sand core from the casting mold.

2. The method according to claim 1 wherein in the step (c) the conditioning gas is dehumidified to a dew point of at least about minus 10 degrees Fahrenheit.

3. The method according to claim 1 wherein in the step (c) the conditioning gas is heated to a temperature within a range from about 200 degrees Fahrenheit to about 400 degrees Fahrenheit.

4. The method according to claim 1 wherein in the step (c) the conditioning gas is dehumidified to a dew point of at least about minus 10 degrees Fahrenheit and heated to a temperature within a range from about 200 degrees Fahrenheit to about 400 degrees Fahrenheit.

5. The method according to claim 1 wherein in the step (f) the controller and exhaust unit are operated to cause the conditioning gas to be selectively moved through the sand core for at least a period of time in each of the first and second gas paths.

6. The method according to claim 1 wherein the first gas path includes at least two control valves and the second gas path includes at least two control valves, the controller operatively connected to the controls valves of the first and second gas paths to selectively control the flow of the conditioning gas therethrough.

7. A sand core produced in accordance with the method of claim 1.

8. A method for producing an inorganic sand core by removing moisture from the inorganic sand core comprising the steps of:

(a) providing a casting mold having a mold cavity and including a first conduit operatively connected to the mold cavity and a second conduit operatively connected to the mold cavity;

(b) providing an inorganic sand core disposed in the mold cavity, the inorganic sand core containing moisture;

(c) providing a supply of conditioning gas to the first conduit and the second conduit to remove the moisture from the inorganic sand core, the conditioning gas being dehumidified;

(d) providing a controller operatively connected to the first conduit and the second conduit to selectively control the supply of the conditioning gas between a first gas path, wherein the conditioning gas enters the casting mold through the first conduit and exits the casting mold through the second conduit, and a second gas path, wherein the conditioning gas enters the casting mold through the second conduit and exits the casting mold through the first conduit;

(e) providing a gas exhaust unit operatively connected to the first conduit and the second conduit;

(f) operating the controller and the gas exhaust unit to cause the conditioning gas to be selectively moved through the inorganic sand core disposed in the mold cavity, the conditioning gas moving through the inorganic sand core in at least one of the paths defined by the first gas path and the second gas path whereby the conditioning gas is operative to remove the moisture from the inorganic sand core; and (g) removing the inorganic sand core from the casting mold.

9. The method according to claim 8 wherein in the step (c) the conditioning gas is dehumidified to a dew point of at least about minus 10 degrees Fahrenheit.

10. The method according to claim 8 wherein in the step (c) the conditioning gas is heated to a temperature within a range from about 200 degrees Fahrenheit to about 400 degrees Fahrenheit.

11. The method according to claim 8 wherein in the step (c) the conditioning gas is dehumidified to a dew point of at least about minus 10 degrees Fahrenheit and heated to a temperature within a range from about 200 degrees Fahrenheit to about 400 degrees Fahrenheit.

12. The method according to claim 8 wherein in the step (f) the controller and exhaust unit are operated to cause the conditioning gas to be selectively moved through the inorganic sand core for at least a period of time in each of the first and second gas paths.

13. The method according to claim 8 wherein the first gas path includes at least two control valves and the second gas path includes at least two control valves, the controller operatively connected to the controls valves of the first and second gas paths to selectively control the flow of the conditioning gas therethrough.

14. An inorganic sand core produced in accordance with the method of claim 8.

15. A method for producing an inorganic sand core by removing moisture from the inorganic sand core comprising the steps of:

(a) providing a casting mold having a mold cavity and including a first conduit operatively connected to the mold cavity and a second conduit operatively connected to the mold cavity;

(b) providing an inorganic sand core disposed in the mold cavity, the inorganic sand core containing moisture;

(c) providing a supply of conditioning gas to the first conduit and the second conduit to remove the moisture from the inorganic sand core, the conditioning gas dehumidified to a dew point of at least about minus 10 degrees Fahrenheit;

(d) providing a controller operatively connected to the first conduit and the second conduit to selectively control the supply of the conditioning gas between a first gas path, wherein the conditioning gas enters the casting mold through the first conduit and exits the casting mold through the second conduit, and a second gas path, wherein the conditioning gas enters the casting mold through the second conduit and exits the casting mold through the first conduit, the first gas path including at least two control valves and the second gas path including at least two control valves, the controller operatively connected to the controls valves of the first and second gas paths to selectively control the flow of the conditioning gas therethrough;

(e) providing a gas exhaust unit operatively connected to the first conduit and the second conduit;

(f) operating the controller and the gas exhaust unit to cause the conditioning gas to be selectively moved through the inorganic sand core disposed in the mold cavity, the conditioning gas moving through the inorganic sand core in at least one of the paths defined by the first gas path and the second gas path whereby the conditioning gas is operative to remove the moisture from the inorganic sand core; and (g) removing the inorganic sand core from the casting mold.

16. The method according to claim 15 wherein in the step (c) the conditioning gas is heated to a temperature within a range from about 200 degrees Fahrenheit to about 400 degrees Fahrenheit.

17. The method according to claim 15 wherein in the step (f) the controller and exhaust unit are operated to cause the conditioning gas to be selectively moved through the inorganic sand core for at least a period of time in each of the first and second gas paths.

18. An inorganic sand core produced in accordance with the method of claim 15.

* * * * *